United States Patent [19]

Venkataraman et al.

[11] Patent Number: 4,919,886

[45] Date of Patent: Apr. 24, 1990

[54] TITANIUM ALLOYS OF THE $TI_3$ AL TYPE

[75] Inventors: Ganapathy Venkataraman, Fairborn; Francis H. Froes, Xenia, both of Ohio

[73] Assignee: The United States of America as represented by the Secretary of the Air Force, Washington, D.C.

[21] Appl. No.: 335,631

[22] Filed: Apr. 10, 1989

[51] Int. Cl.[5] ..... C22C 14/00

[52] U.S. Cl. ..... 420/420; 420/418

[58] Field of Search ..... 420/420, 418

[56] References Cited

U.S. PATENT DOCUMENTS 2,880,087 3/1959 Jaffee ..... 420/420

4,292,077 9/1981 Blackburn et al. ..... 420/418

4,716,020 12/1987 Blackburn et al. ..... 420/418

4,788,035 11/1988 Gigliotti et al. ..... 420/420

4,810,465 3/1989 Kimura et al. ..... 420/418

*Primary Examiner*—L. Dewayne Rutledge

*Assistant Examiner*—Margery S. Phipps

*Attorney, Agent, or Firm*—Charles E. Bricker; Donald J. Singer

[57] ABSTRACT

A titanium alloy comprising about 20 to 30 atomic percent (a/o) aluminum, about 3 to 5 a/o niobium, about 3 to 5 a/o vanadium, and about 3 to 5 a/o molybdenum, balance titanium. The alloy can be dispersion strengthened by the addition of small amounts, i.e. up to about 1 a/o of sulfur or rare earth dispersoids, such as Ce, Er or Y.

5 Claims, No Drawings

TITANIUM ALLOYS OF THE $TI_3$ AL TYPE

RIGHTS OF THE GOVERNMENT

The invention described herein may be manufactured and used by or for the Government of the United States for all governmental purposes without the payment of any royalty.

BACKGROUND OF THE INVENTION

This invention relates to tri-titanium aluminide alloys.

Titanium alloys have found wide use in gas turbines in recent years because of their combination of high strength and low density, but generally, their use has been limited to below 600° C. by inadequate strength and oxidation properties. At higher temperatures, relatively dense iron, nickel, and cobalt base super-alloys have been used. However, lightweight alloys are still most desirable, as they inherently reduce stresses when used in rotating components.

While major work was performed in the 1950's and 1960's on lightweight titanium alloys for higher temperature use, none have proved suitable for engineering application. To be useful at higher temperature, titanium alloys need the proper combination of properties. In this combination are properties such as high ductility, tensile strength, fracture toughness, elastic modulus, resistance to creep, fatigue, oxidation, and low density. Unless the material has the proper combination, it will fail, and thereby be use-limited. Furthermore, the alloys must be metallurgically stable in use and be amenable to fabrication, as by casting and forging. Basically, useful high temperature titanium alloys must at least outperform those metals they are to replace in some respects and equal them in all other respects. This criterion imposes many restraints and alloy improvements of the prior art once thought to be useful are, on closer examination, found not to be so. Typical nickel base alloys which might be replaced by a titanium alloy are INCO 718 or INCO 713.

Heretofore, a favored combination of elements for higher temperature strength has been titanium with aluminum, in particular alloys derived from the intermetallic compounds or ordered alloys $Ti_3Al$ (alpha 2) and TiAl (gamma). Laboratory work in the 1950's indicated these titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys.

There are two basic ordered titanium aluminum compounds of interest—$Ti_3Al$ and TiAl which could serve as a base for new high temperature alloys. Those well skilled recognize that there is a substantial difference between the two ordered phases. Alloying and transformational behavior of $Ti_3Al$ resemble those of titanium as the hexagonal crystal structures are very similar. However, the compound TiAl has a tetragonal arrangement of atoms and thus rather different alloying characteristics. Such a distinction is often not recognized in the earlier literature. Therefore, the discussion hereafter is largely restricted to that pertinent to the invention, which is within the $Ti_3Al$ alpha-two phase realm, i.e., about 75Ti-25Al atomically and about 86Ti-14Al by weight.

With respect to the early titanium alloy work during the 1950's, several U.S. and foreign patents were issued. Among them were Jaffee U.S. Pat. No. 2,880,087, which disclosed alloys with 8–34 weight percent aluminum with additions of 0.5 to 5% beta stabilizing elements (Mo, V, Nb, Ta, Mn, Cr, Fe, W, Co, Ni, Cu, Si, and Be). The effects of the various elements were distinguished to some extent. For example, vanadium from 0.5–50% was said to be useful for imparting room temperature tensile ductility, up to 2% elongation, in an alloy having 8–10% aluminum. But with the higher aluminum content alloys, those closest to the gamma TiAl alloy, ductility was essentially non-existent for any addition.

During the 1960's and 1970's considerable work was done by and for the U.S. Air Force covering the Ti-Al-Nb system. In U.S. Pat. No. 4,292,077. "Titanium Alloys of the $Tl_3Al$ Type". Blackburn and Smith identify 24–27 atomic percent aluminum and 11–16 atomic percent niobium as the preferred composition range. High aluminum increases strength but hurts ductility. High niobium increases ductility but hurts high temperature strength. Vanadium is identified as being able to be substituted for niobium up to about 4 atomic percent.

In U.S. Pat. No. 4,788,035, "Tri-Titanium Aluminide Base Alloys of Improved Strength and Ductility", Gigliotti and Marquardt disclose a $Tl_3Al$ base composition having increased tensile strength, ductility and rupture life due to the addition of Ta, Nb and V.

Nb alone has been used as a principal beta phase promoter in $Ti_3Al$. As noted previously, V can be substituted for Nb up to about 4 atomic percent. We found that rapidly solidified $Ti_3Al$ alloy containing 12 atomic percent Nb was somewhat ductile at room temperature due to its alpha two plus beta two structure. However, the alloy became brittle after exposure above 750° C. due to conversion of the beta two to alpha two.

Accordingly, it is an object of the present invention to provide a $Ti_3Al$ alloy having room temperature ductility and high temperature strength.

Other objects and advantages of the present invention will become more apparent from the following description of the invention.

DESCRIPTION OF THE PREFERRED EMBODIMENT

In accordance with the present invention there is provided a titanium alloy comprising about 20 to 30 atomic percent (a/o) aluminum, about 3 to 5 a/o niobium, about 3 to 5 a/o vanadium, and about 3 to 5 a/o molybdenum, balance titanium. These alloys may be stated in nominal weight percent as Ti-11.2/17.4Al-5.8/10Nb-3.2/5.5V-6/10.3 Mo.

The preferred embodiment herein is described in terms of atomic percents (a/o) as this is the manner in which it was conceived and is generally understood. Those skilled in the art can readily convert from atomic percents to exact weight percents for particular alloys.

The alloys of the present invention can be dispersion strengthened by the addition of small amounts, i.e. up to about 1 a/o of sulfur or rare earth dispersoids, such as Ce, Er or Y.

While alloys containing Ti, Al, Nb, Mo, and V have been known previously, they did not have ductility at lower temperatures as well as being useable at temperatures of 600° C. and above. The compositional ranges revealed herein are quite narrow, as the properties are more critically dependent on the precise composition than was known heretofore.

It is presently preferred that the alloys of this invention be prepared using a rapid solidification (RS) technique, particularly when one or more dispersion strengthening component is incorporated therein. Several techniques are known for producing rapidly-solidified foil, including those known in the art as Chill Block Melt Spinning (CBMS), Planar Flow Casting (PFC), melt drag (MD), Crucible Melt Extraction (CME), Melt Overflow (MO) and Pendant Drop Melt Extraction (PDME). Typically, these techniques employ a cooling rate of about $10^5$ to $10^7$ deg-K/sec and produce a material about 10 to 100 micrometers thick, with an average beta grain size of about 2 to 20 microns, which is substantially smaller than the beta grain produced by ingot metallurgy methods.

The rapidly solidified material can be consolidated in a suitable mold to form sheetstock, bar-stock or net shape articles such as turbine vanes. Consolidation is accomplished by the application of heat and pressure over a period of time. Consolidation is carried out at a temperature of about 0° to 250° C. (0° to 450° F.) below the beta transus temperature of the alloy. The pressure required for consolidation ranges from about 35 to about 300 MPa (about 5 to 40 Ksi) and the time for consolidation ranges from about 15 minutes to 24 hours or more. Consolidation under these conditions permits retention of the fine grain size of the rapidly solidified alloy.

The following example illustrates the invention:

EXAMPLE

A series of alloys were prepared having the composition shown in Table I, below.

TABLE I

| ALLOY | Composition (atomic %) |
|---|---|
| A | Ti-24Al-4Nb-4Mo-4V |
| B | Ti-24Al-4Nb-4Mo-4V-0.2Er-0.2Ce-0.2Y |
| C | Ti-24Al-4Nb-4Mo-4V-0.3Er-0.3Ce-0.3Y |

The compositions shown in Table I were vacuum arc melted using high purity raw materials. They were converted to rapidly solidified ribbons by melt spinning in an inert atmosphere. The ribbons had widths of 3 to 5 mm and thickness ranged from about 20 to about 60 μm. The ribbons were characterized by optical microscopy with Nomarskii contrast. Ductility was semiquantitatively evaluated by bending over cylindrical mandrels.

The crystal structures of the chill and top surfaces were separately determined by X-ray diffractometry with crystal monochromatic Cu radiation. Thin foils for STEM analysis were prepared by double jet electropolishing. Microstructual analysis was done in a JEOL 100CX microscope.

OPTICAL MICROSCOPY—The ingot metallurgy (IM) samples of Alloys B and C in the as-polished condition showed large oxide particles of 5–10 μm and coarse particles along prior beta-grain boundaries. They were rich in rare earth elements and sulphur. The rapidly solidified structure of Alloy B showed a two-zone microstructure consisting of fine equiaxed grains at the chill side and coarse grains at the top side with a size range of 1–5 μm. At the top layer segregation was noticed at grain boundaries after deep etching. The as-quenched structure of Alloy C showed a different type of two-zone structure. When the thickness of ribbon was less than 30 μm, columnar grains and equiaxed grains were seen. For a thicker than average portion of the rapidly solidified ribbon, columnar structure was absent and there were unmelted particle inclusions.

BEND DUCTILITY—The ribbons of Alloy A could be bent upon themselves by 180° with sharp root radius without fracture. The calculated ductility at the outer fiber, after bending, exceeded 70–90% in several ribbons of Alloy A. Alloy B showed reduced ductility of 5–10%, while Alloy C had 3–6%.

X-RAY DIFFRACTOMERY—The diffraction patterns of all the three IM alloys showed, qualitatively, a very high volume fraction of hexagonal phase (alpha-2) and small amounts of the BCC phase (β2). The diffraction patterns of the separate chill surfaces and top surfaces of rapidly solidified ribbons contained this first five peaks of the BCC structure, i.e., (110), (200), (211), (310), and (310). Hexagonal phase (alpha-2) was absent throughout. The lattice spacing of BCC phase was 0.323–0.325 nm in all three alloys.

STEM RS Alloy A—Alloy A showed fine grains with BCC (β2) structure and the grain size varied from 0.5 μm to 5 μm. Antiphase domains (APD) were seen clearly with size in the range of 150–300 nm. There was tweed-like fine contrast within certain grains, indicating the presence of a very fine second phase. The diffraction pattern revealed BCC spots and super-lattice spots, and streaks were observed along <110>. Streaks were also observed in several Selected Area Diffraction Pattern (SADP).

STEM RS ALLOY B—The dispersoids had two types of distributions with a wide range of size and distance between particles. The first type showed particles only along grain boundary (GB) of β2 phase. The typical SADP indicated super-lattice spots of BCC phase (β2) and streaks due to W phase similar to that of Alloy A. The grain size was typically 0.5–2 μm and the particles were widely spaced/discontinuous along GB of β2 phase. The particles of 10–30/nm were agglomerated as groups with up to 5–6 particles in each group with size 50–60 nm. The APD contrast in some grains measured 100–300 nm. STEM analysis of these particles revealed high concentrations of Er, Ce, Y, and S.

The second type of dispersoid distribution was formed within the β2 grains and along GB. The APD had a size range of 100–300 nm and the dispersoids did not occupy any preferential site in the APD. The particles were more or less closely spaced along GB.

The GB precipitates measured 10–30 nm while the precipitates within grains were somewhat finer, measuring 5–20 nm, and the dispersoid spacing was 30–50 nm. Fine particles of size less than 10 nm were seen along sub-boundaries. The dispersoids of size 10–30 nm were seen as groups along GB.

STEM RS ALLOY C—Two distinctly separate types of dispersoid distribution and size were observed in these ribbons. In the first type, the fine grains of 0.5–2 μm (β2 phase) had closely spaced dispersoids along the GB. In some locations the dispersoids were seen over a band along the GB. Occasionally clusters of dispersoids of rather bigger size (30–70 nm) were observed along the GB; the grain interior showed finer particles of 5–20 nm with spacing around 50–100 nm.

The second type of microstructure consisted of fine dispersoids both within the $\beta 2$ grains and at the GB. The dispersoids measured 5–10 nm with spacings of 50–100 nm. The GB particles were discontinuous and fine. The APD had size ranges of 50–200 nm and the dispersoids were randomly distributed over APD.

In the alloy of this invention, containing about 12 atomic percent of three beta-isomorphous elements, beta-2 structure is obtained after rapid solidification. In contrast, the alloy Ti-24Al-12Nb produced a mixed structure of beta-2 and alpha-2, the latter being undesirable for good ductility.

Various modifications may be made to the invention as described without departing from the spirit of the invention or the scope of the appended claims.

We claim:

1. A titanium alloy consisting essentially of about 20 to 30 atomic percent aluminum, about 3 to 5 atomic percent niobium, about 3 to 5 atomic percent vanadium and about 3 to 5 atomic percent molybdenum, balance titanium.

2. The alloy of claim 1 further containing up to about 1 atomic percent of at least one of sulfur, Ce Er or Y.

3. The alloy of claim 1 having the composition Ti-24Al-4Nb-4Mo-4V.

4. The alloy of claim 2 having the composition Ti-24Al-4Nb-4Mo-4V-0.2Er-0.2Ce-0.2Y.

5. The alloy of claim 2 having the composition Ti-24Al-4Nb-4Mo-4V-0.3Er-0.3Ce-0.3Y.

* * * * *